US005117226A

United States Patent [19]

Song

[11] Patent Number: 5,117,226

[45] Date of Patent: May 26, 1992

[54] CIRCUIT FOR GENERATING A SCROLL WINDOW SIGNAL IN DIGITAL IMAGE APPARATUS

[75] Inventor: Kwang-Sup Song, Seoul, Rep. of Korea

[73] Assignee: SamSung Electronics Co., Ltd., Suwon, Rep. of Korea

[21] Appl. No.: 366,538

[22] Filed: Jun. 15, 1989

[51] Int. Cl.[5] ..... G09G 1/06

[52] U.S. Cl. ..... 340/726; 340/814

[58] Field of Search ..... 340/726, 803, 814, 740, 340/749, 724, 721; 377/39, 45

[56] References Cited

U.S. PATENT DOCUMENTS 4,199,790 4/1980 Greenfield et al. ..... 358/183

4,605,967 8/1986 Pires ..... 358/183

*Primary Examiner*—Ulysses Weldon

*Assistant Examiner*—Xiao Min Wu

*Attorney, Agent, or Firm*—Robert E. Bushnell

[57] ABSTRACT

A circuit for generating a scroll screen window signal which is capable of displaying on a display device a desired scroll screen by separating vertically, the screen being displayed in a given corresponding scroll mode. The circuit also compares scroll screen mode signals for discriminating a given mode by use of (+), (−) key input signal representing a scroll type. The improved invention comprises: an OR gate for receiving a basic clock signal 3.58 MHz; a first counter CNT1 and a second counter CNT2 for receiving a synchronous signal from a synchronized-divider and receiving an output of the OR gate; a first AND gate and a second AND gate for receiving a right/left scroll window selecting signal generated by a user; a third counter CNT3 for receiving a scroll window selecting signal from a fifth input terminal and generating a scroll window setting signal; a plurality of exclusive OR gates and a NOR gate for receiving outputs counted from the second counter and third counter, comparing the outputs, performing a logical operation upon them, and generating a scroll window signal to be applied to the OR gate; and a first NAND gate and a second NAND gate for receiving the output of the second counter after inverting outputs of the second counter in a given manner.

9 Claims, 4 Drawing Sheets

CIRCUIT FOR GENERATING A SCROLL WINDOW SIGNAL IN DIGITAL IMAGE APPARATUS

BACKGROUND OF THE INVENTION

This invention relates to a circuit for generating scroll window signal in digital image apparatus, and particularly to a circuit for generating a scroll window signal capable of displaying two different screen sources, one on the right and the other on the left section of a common screen, simultaneously.

The prior techniques of displaying more than two screen sources simultaneously on a common screen such as a picture-in-picture system and a scroll screen displaying system are disclosed. The picture-in-picture system, which inserts a small screen into a main screen having a different screen source, has an advantage in that it can display an entire original source screen. However, it has a shortcoming in that it is difficult for the viewer to watch the full screen at a far distance because it is displayed with a small screen.

The method of displaying a small screen is a technique that displays two screens having different screen sources simultaneously on a common screen, one on the top and the other on the bottom, or one on the right and the other on the left, respectively. The system displays either the two pictures within the same size or one of them with large size covering the other small picture In the scroll window displaying system, although the entire part of the screen can be watched just as it is with its given size of a screen frame, the portion covered by scrolling cannot be displayed.

When a multiple screen is selected and displayed in a conventional scroll window displaying system, the desired portion of the screen is displayed by setting a window by means of handling selection keys of a top and bottom or a right and left. However, the top and bottom or the right and left window scrolling method has different screen selecting window pulses according to the types of a scroll screen. Then, each screen scroll type is selected by decoded window signal.

Therefore, it has a disadvantage in that the selecting logic circuit for selecting screen scroll types becomes complicated and the capacity for logic signal processing must be enlarged in scope.

SUMMARY OF THE INVENTION

It is an object of the present invention to provide a circuit for comparing scroll screen mode signals for discriminating a given mode by means of (+), (−) key input signal representing a scroll type.

It is another object of the present invention to provide a circuit for generating a scroll screen window signal suitable to a scroll screen mode.

It is further another object of the present invention to provide a circuit capable of displaying on a displaying device a desired scroll screen by separating vertically a screen which is corresponding to a given scroll mode.

According to one aspect of the present invention, the circuit for generating a scroll screen window signal includes: an OR gate for receiving a basic clock signal 3.58 MHz; a first counter CNT1 and a second counter CNT2 for receiving a synchronous signal, from a synchronized-divider and receiving an output of the OR gate; a first and second AND gate for receiving a right-/left scroll window selecting signal generated by a user; a third counter CNT3 for receiving a scroll window selecting signal from a fifth input terminal and generating a scroll window setting signal; a plurality of exclusive 0R gates and a NOR gate for receiving outputs counted from the second counter and the third counter, comparing the outputs, performing a logical operation upon them, and generating a scroll window signal to be inputted to the NOR gate; and a first and second NAND gate for receiving the output of the second counter after inverting outputs of the second counter in a given manner.

BRIEF DESCRIPTION OF THE DRAWINGS

For a better understanding of the present invention and to show how the same may be carried into effect, reference will now be made, by way of example, to the accompanying diagrammatic drawings, in which.

DETAILED DESCRIPTION OF THE PREFERRED EMBODIMENTS

The invention will now be described in detail with reference to the accompanying drawings.

Figure 1:
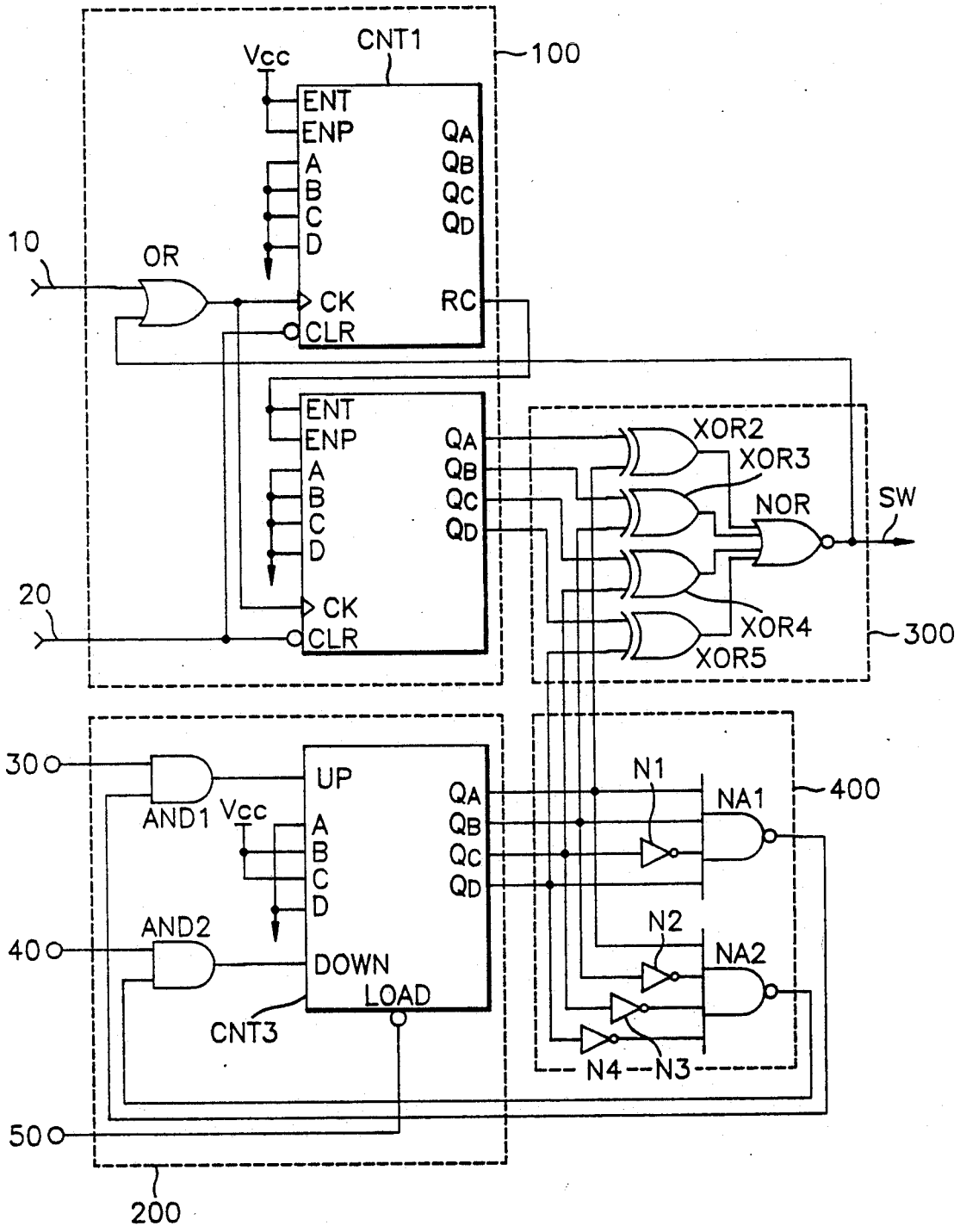
FIG. 1 is a specific diagram illustrating the inventive circuit according to this invention.

Referring to FIG. 1, the inventive circuit for generating a scroll screen window signal is schematically shown, wherein: a first device 100 including an OR gate for receiving a basic clock signal 3.58 MHz with first input terminal 10, and a first and a second counter CNT1, CNT2 for receiving a synchronous signal for reading the data generated from a synchronous divider (not shown) with a clear input terminal CLR, thereby receiving the output of the OR gate in a clock terminal CK of the first and second counters according to an input signal of the second input terminal 20, and counting in a given manner the signal from the clock terminal CK;

a second device 200 including two AND gates AND1, AND2 for receiving, through third and fourth input terminals 30, 40, the scroll window right/left selection signal generated by a user, and a third counter CNT3 for receiving the output of the AND gates AND1, AND2 through a count-up and a count-down terminal thereof, and thereby counting the output of the AND gates, a load terminal LOAD of the third counter CNT3 receiving a scroll selection signal through a fifth input terminal 50 while input terminals A, B, C, D thereof are set for a middle position of the scroll screen;

a third device 300 having four exclusive OR gates XOR2 through XOR5 for receiving the counted value from the first and second devices 100, 200, thereby comparing the counted values, and a NOR gate NOR for performing logical operation upon the scroll window signal to produce the output to an output terminal SW, the output being inputted to the OR gate of the first device 100 to set a corresponding scroll window; and a fourth device 400 including four inverters N1 to N4 for receiving the output of the second device 200 to produce an inverted output to NAND gates NA1, NA2, the NAND gates generating a window recognition signal corresponding to a leftmost and rightmost side of the screen to send the signal to AND gates AND1 and AND2.

Figure 2:
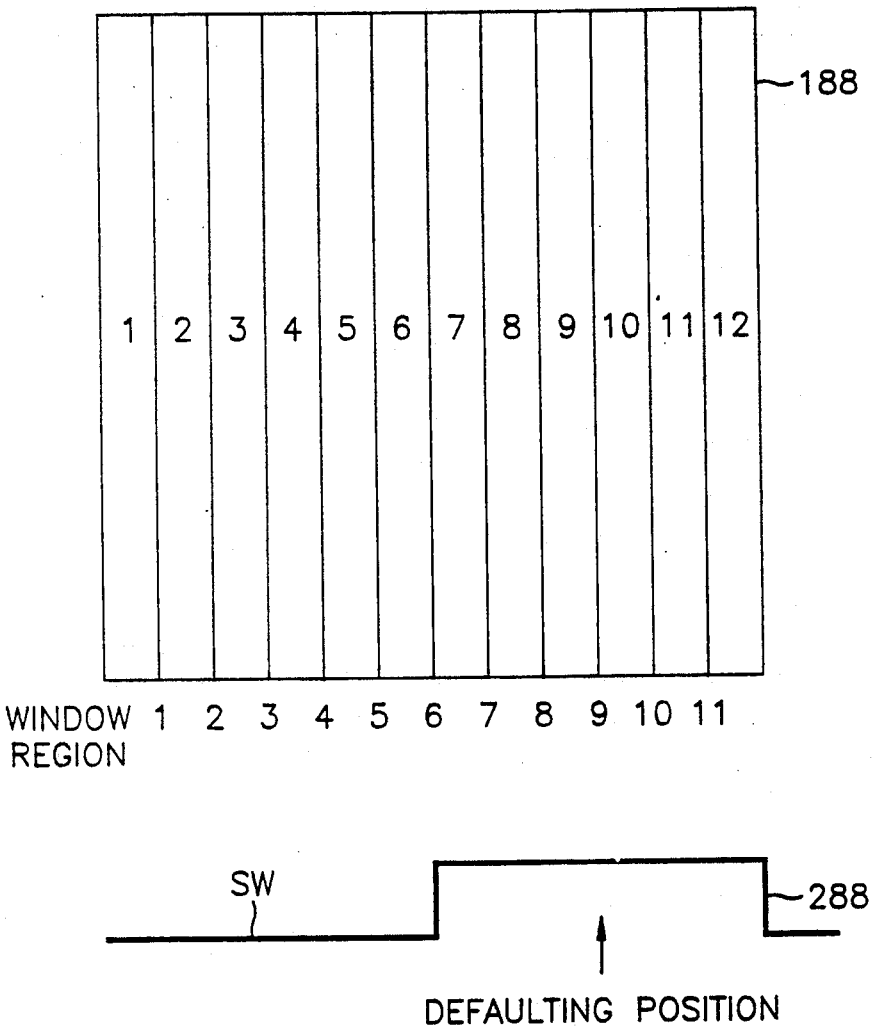
FIG. 2 is an operational diagram specifically illustrating a scroll window screen of a preferred embodiment according to this invention.

FIG. 2 is an operational diagram according to the present invention. When a scroll screen 188, vertically set in division, is divided into twelve scroll position setting modes, it is intended to display a main screen on the left side and a digital sub-screen on the right side according to the output signal generated in the output terminal SW of the scroll window selecting signal generated in the NOR gate NOR of FIG. 1. Namely, the size of the right and left screen is proportionally changed according to the change of the scroll window selecting signal SW. A defaulting window selecting position shown in FIG. 2 is in its initial position 288, because a scroll function is set up automatically for an initial state, namely, the input terminals A–D of counter 3 CNT3 are set up preferentially at a value of 0110.

Figure 3A:
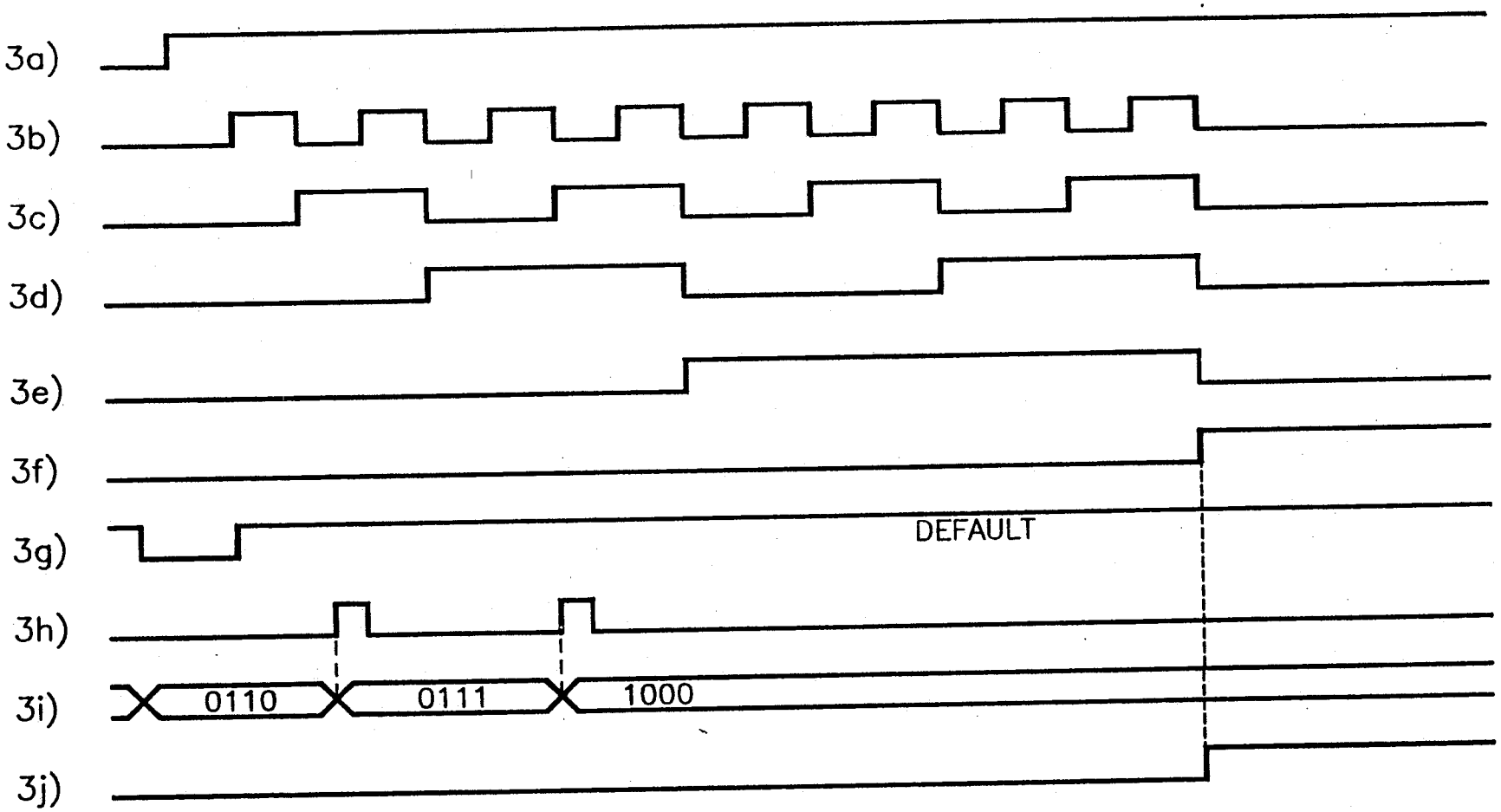
FIGS. 3A and 3B are an operational waveform diagram according to this invention.
Figure 3B:
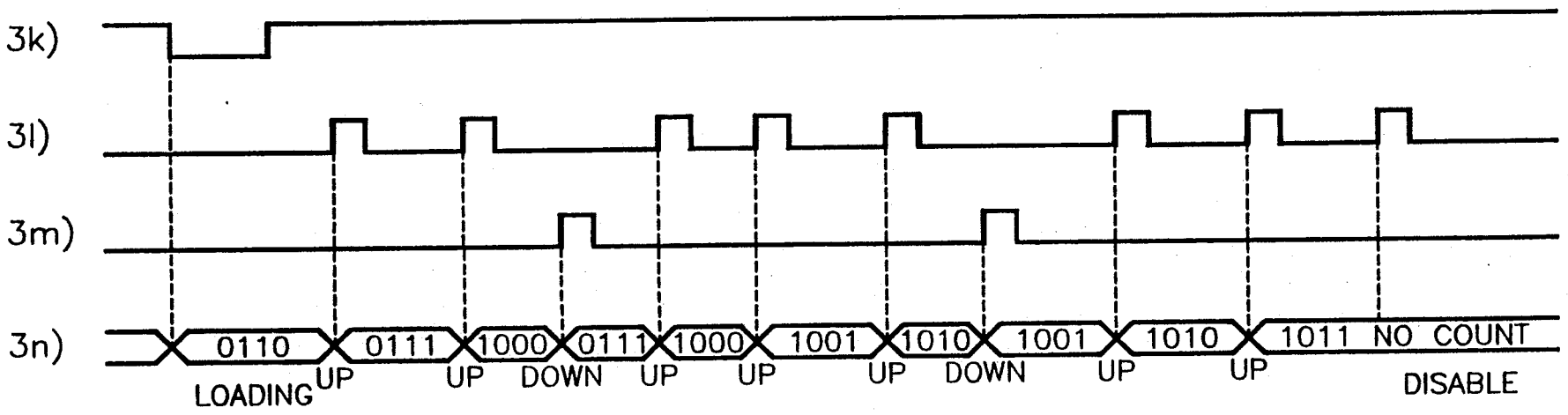

FIGS. 3A and 3B are an operational timing chart of FIG. 1 according to the present invention, in which:

(3*a*)shows a read start signal inputted to the second input terminal 20 in FIG. 1;

(3*b*)–(3*f*) show output signals of output terminals QA–QD of the second counter CNT2 in FIG. 1;

(3*g*) shows a control input signal of scroll mode terminal to the fifth input terminal 50;

(3*h*) shows an input signal waveform of the third input terminal 30;

(3*i*) shows an output data waveform of the third counter CNT3;

(3*j*) shows a scroll window signal waveform from the NOR gate; and (3*k*)–(3*n*) show the waveforms from the third counter CNT3 according to the third and fourth input terminals 30, 40.

In FIG. 1, if a user turns the scroll function key (not shown) on, the scroll pulse becomes logic high. The scroll selecting signal of the fifth input terminal 50 is as 3*g*, 3*k* because it is accepted as active low state. Subsequently, a read-start signal is made in a main synchronous signal generating circuit (not shown) during the scrolling, by which the first and second counters CNT1, CNT2 are cleared. Beginning with this, said first and second counters CNT1, CNT2 start counting from an address 0.

If the whole screen 188 is set up with twelve modes as shown in FIG. 2, a window 1 region is cleared at the next synchronous region, a reference frequency being counted 16 times and a window being generated. And the window selecting signal of a window 12 region is generated after the reference frequency is counted $16\times11=176$ times. Namely, a scroll window requires eleven windows according to the position of each screen scroll. When the scroll is in the "on" state, the position 288 of the scroll is automatically in the initial position as in FIG. 2.

A preferred embodiment of FIG. 2 will be illustrated detail hereinafter according to FIG. 3, with reference to FIG. 1. The first and the second counters CNT1, CNT2 are cleared by each read-start signal received from a second input terminal 20. Hence, the read-start signal is to match initial parts of virtual image signal except a synchronous signal of an image synthesized signal.

After the first and the second counters CNT1, CNT2 are cleared by a signal (3*a* ) in FIG. 3, when an input clock signal is counted by a reference frequency clock 3.58 MHz applied to the first input terminal 10 to the clock terminal CK of the first and second counters CNT1, CNT2 through the OR gate, the output signal (3*b*) from the output terminal (QD) of counter 1 CNT1 is outputted. When the ripple carry signal of the first counter CNT1 is carried to the second counter CNT2, and the input clock signal of the OR gate is counted, the output signals of the output terminals QA–QD of the second counter CNT2 are output as (3*c*)–(3*f*), and applied to exclusive OR gates XOR2–XOR5. During a period of one horizontal synchronous video signal, one horizontal screen can be completely carried out by thee first and second counters CNT1, CNT2, wherein a counting duration of about 192 is needed to count all of the effective screen section.

As a result, the 5-bit-counting output out of 8 bits is outputted as (3*b*)–(3*f*) in FIG. 3. Therefore, if a user inputs a scroll key, such as (3*g*), (3*k*) in FIG. 3 is generated and the load terminal LOAD of the third counter CNT3 is activated.

Since the states of the input terminals A, B, C, and D of the third counter CNT3 are all in 0110 simultaneously with the activation of the third counter CNT3, the output (3*i*) of the output terminals QA–QD of the third counter CNT3 is output as (3*i*). Thereafter, it is compared with the output of the second counter CNT2 at the exclusive OR gates XOR2 to XOR5 and passed through the NOR gate. Then, a window selecting signal corresponding to the middle position of the scroll screen window in FIG. 2 is output. If the selecting signal to the OR gate OR, the pulse of the first and second counters CNT1, CNT2 is stopped, causing the counters to stop counting. It is a preferred example of showing two different screen sources in the same size. Namely, if the screen sources are to illustrate two different people's faces, only halves of each person's face are displayed on the scroll screen.

If a user selects the key (+) to display the left half of the screen, the input of (3*h* ) is applied to the AND gate AND1 of the third input terminal 30. When the output of the NAND gate NA1 is applied to the other input terminal of the AND gate AND1 an output of the AND gate AND1 is applied to the up-counter terminal of the third counter CNT3. The third counter CNT3 is up-counted from 0110 as (3*i*) and finally a sequence the output 0110→0111→1000 occurs at output terminals QA–QD.

The output of the third counter CNT3 is compared with the output of the output terminals QA–QD of the second counter CNT2 at the exclusive OR gates XOR-2–XOR5. Then, if the outputs of the second and third counters CNT2, CNT3 are all the same, all the outputs of the exclusive OR gates XOR2–XOR5 become logic low, and the scroll window signal is generated to be logic high as (3*j*) by the NOR gate NOR.

Namely, when the region 8 of a selected window point in FIG. 12 is selected and the scroll window is generated, the first and second counters CNT1, CNT2 are always applied logic high to the clock terminal CK by a scroll window signal inputted to the OR gate OR, thereby stopping to count. Thereafter, the scroll window is cleared by the read-start signal applied to the second input terminal 20.

If (−) key is used, it is applied to the AND gate AND2 through the fourth input terminal 40 and the output of NAND gate NA2 is applied to the other input terminal of the AND gate AND2. Therefore, if the third counter CNT3 is set for down-counter by the output of the NAND gate NA2 to count down, the outputs of the output terminals QA–QD of the third counter CNT3 are down-counted and applied to the exclusive OR gates XOR2–XOR5. Thereafter, it is compared with the output of the second counter CNT2. According to the above compared values, when all of the values become logic low, the output of the NOR gate NOR becomes logic high. Hence a window is set for that the left scroll screen in FIG. 2 is reduced and the right-sub digital screen is displayed in a large scale, The window of scroll screen 1 in FIG. 2 is freely selected by (3*k*)–(3*n*) in FIG. 3, according to the change of inputs of the third and fourth input terminals 30, 40. In case that the output of output terminals QA–QD of the third counter CNT3 is 0001 corresponding to the leftmost window or 1011 corresponding to the rightmost window, the outputs of the NAND gates NA1, NA2 become logic low and are applied to the AND gates AND1, AND2. Therefore, the output of the AND gates AND1, AND2 becomes logic low and any inputs of the third counter CNT3 are not accepted. So, the scroll screen window does not exceed over a given scope.

In the preferred embodiment according to this invention, there are 11 scroll windows on a screen. However, scroll function can be easily elevated by increasing the number of scroll screen window, applying 5 bit→6 bit→7 bit→8 bit instead of 4 bit.

As described above, the scroll window signal can be generated, easily and effectively, by using a picture-in-picture technique or a horizontal synchronous counter for use in the other various digital processing and by key Control with a help of the up/down counter.

While the invention has been particularly shown and described with reference to a preferred embodiment , it will be understood by those skilled in the art that modifications in detail may be made without departing from the spirit and scope of the invention.

What is claimed is:

1. A scroll window signal generating circuit for use in digital image processing, comprising:

an OR gate coupled to receive a basic clock signal through a first input terminal, for providing a first clock signal;

first and second counter means for receiving a synchronous signal at a clear terminal of each said counter means and receiving said first clock signal from said OR gate at a clock terminal of each of said counter means to produce first output signals;

first and second AND gates for receiving right and left scroll window selecting signals, respectively, generated by a user at each respective first input terminal and rightmost/leftmost scroll window recognition signals at each respective second input terminal to provide first intermediate signals;

third counter means set for use as an up/down-counter according to said right and left scroll window selecting signals and rightmost/leftmost scroll window recognition signals, for receiving a scroll selecting signal at a load terminal and first intermediate signals to generate scroll window setting signals;

a plurality of exclusive OR gates and a NOR gate for receiving said first output signals and said scroll window setting signals, for performing a logical operation on said first output signals and scroll window setting signals to generate a scroll window signal at an output terminal of said NOR gate, said scroll window signal being delivered to a second input terminal of said OR gate for setting a scroll window according to said scroll window signal; and first and second NAND gates for receiving said scroll window setting signals after inverting said scroll window setting signals through a plurality of inverts, thereby generating, by a logical combination, rightmost/leftmost scroll window recognition signals corresponding to a rightmost/leftmost window of a screen for stopping the movement of said window, regardless of subsequent key inputs from said third counter.

2. A scroll window signal generating circuit as set forth in claim 1, wherein said first and second AND gates set said third counter means to be an up/down-counter operating pursuant to signals from said first and second NAND gates, and said third counter means is set to select initially a middle window of the scroll screen.

3. A scroll window signal generating circuit as set forth in claim 1, wherein said plurality of exclusive OR gates compare said first output signal and said scroll window setting signals, and the NOR gate logicizes the results of the comparison made by said exclusive OR gates to generate a scroll window signal.

4. A scroll window signal generating circuit as set forth in claim 2, wherein said plurality of exclusive OR gates compare said first output signal and said scroll window setting signals, and the NOR gate performs logical operations upon the results of the comparison made by said exclusive OR gates to generate a scroll window signal.

5. A scroll window signal generating circuit for use in digital image processing, comprising:

an OR gate for receiving a basic clock signal at a first input terminal for providing a first clock signal;

a first counter coupled to receive a synchronous signal and said first clock signal to generate a carry signal;

a second counter coupled to receive said synchronous signal, said first clock signal, and said carry signal to generate a first output signal.

a first AND gate coupled to receive right scroll window selecting signals generated by a user through a first input terminal;

a second AND gate coupled to receive left scroll window selecting signals generated by a user through a first input terminal;

a third counter, set for use as an up/down-counter according to said right and left scroll window selecting signals, and rightmost/leftmost scroll window recognition signals, coupled to receive a scroll selection signal at a load terminal and the outputs of said first and second AND gates to generate scroll window setting signals by counting;

a plurality of exclusive OR gates and a NOR gate coupled to receive said first output signal and said scroll window setting signals for comparing said first output signal and said scroll window setting signals to generate second output signals, performing a logical operation on said second output signals to generate a scroll window signal to be delivered to a second input terminal of said OR gate; and first and second NAND gates coupled to receive said scroll window setting signals and inverted ones of said scroll window setting signals to generate, by a logical combination, rightmost/leftmost scroll window recognition signals to be delivered to a second input terminal of said first and second AND gates corresponding to a rightmost/leftmost window of a screen for stopping movement of said window.

6. A scroll window signal generating circuit for use in digital image processing, comprising:

first logic means coupled to receive a basic clock signal at a first input terminal for providing a first clock signal;

first and second counter means for receiving a synchronous signal at a clear terminal of each of said counter means and receiving said first clock signal from said first logic means at a clock terminal of each of said counter means to produce first output signals;

second logic means for receiving right and left scroll window selecting signals, respectively, generated by a user at respective input terminals;

third counter means set for use as an up/down-counter according to said right and left scroll window selecting signals and rightmost/leftmost scroll window recognition signals, for receiving a scroll selecting signal at a load terminal of said third counter means and the output signals of said second logic means to generate scroll window setting signals;

third logic means for receiving said first output signals and said scroll window setting signals for performing a logical operation on said first output signals and said scroll window setting signals to generate a scroll window signal, said scroll window signal being applied to a second input terminal of said first logic means for setting a scroll window according to said scroll window signal; and fourth logic means for receiving said scroll window setting signals and inverted scroll window setting signals to generate scroll window recognition signals corresponding to a rightmost/leftmost window of a screen for stopping the movement of said window to be delivered to said 7. A scroll window signal generating circuit as set forth in claim 6, wherein said second logic means set said third counter means to be an up/down-counter operating pursuant to signals from said fourth logic means, and said third counter means is set to initially select a middle window of the scroll screen.

8. A scroll window signal generating circuit as set forth in claim 6, wherein said third logic means makes a comparison of said first output signals and scroll window setting signals, and generates said scroll window signal on the basis of said comparison.

9. A scroll window signal generating circuit as set forth in claim 7, wherein said third logic means makes a comparison of said first output signals and scroll window setting signals, and generates said scroll window signal on the basis of said comparison.

* * * * *

UNITED STATES PATENT AND TRADEMARK OFFICE

CERTIFICATE OF CORRECTION

PATENT NO. : 5,117,226

DATED : 26 May 1992

INVENTOR(S) : Kwang-Sup SONG

It is certified that error appears in the above-identified patent and that said Letters Patent is hereby corrected as shown below:

Column 1, Line 29, insert a period --.-- after "picture";

IN THE CLAIMS

Claim 1, Column 6, Lines 5 and 6, change " inverts" to --inverters--.

Claim 6, Column 8, Line 10, insert --second logic means-- after "said".

Signed and Sealed this

Twenty-eighth Day of September, 1993

Bruce Lehman

*Attest:*

BRUCE LEHMAN

*Attesting Officer*

*Commissioner of Patents and Trademarks*